US010472117B1

(12) United States Patent
Meyer

(10) Patent No.: US 10,472,117 B1
(45) Date of Patent: Nov. 12, 2019

(54) CONNECTABLE BEVERAGE BOTTLE

(71) Applicant: Jeffery Meyer, Pomona, CA (US)

(72) Inventor: Jeffery Meyer, Pomona, CA (US)

( * ) Notice: Subject to any disclaimer, the term of this patent is extended or adjusted under 35 U.S.C. 154(b) by 0 days.

(21) Appl. No.: 16/004,917

(22) Filed: Jun. 11, 2018

(51) Int. Cl.

| | |
|---|---|
| ***B65D 21/00*** | (2006.01) |
| ***B65D 1/02*** | (2006.01) |
| ***B65D 21/02*** | (2006.01) |
| ***A45F 3/16*** | (2006.01) |
| ***A45F 5/02*** | (2006.01) |
| ***B65D 23/00*** | (2006.01) |

(52) U.S. Cl.
CPC ..... *B65D 1/0223* (2013.01); *B65D 21/0204* (2013.01); *A45F 3/16* (2013.01); *A45F 5/02* (2013.01); *B65D 21/0201* (2013.01); *B65D 23/003* (2013.01)

(58) Field of Classification Search
CPC .. A45C 11/34; B65D 1/0223; B65D 21/0204; B65D 81/3288; B65D 67/02; B65D 21/0201; B65D 21/0223; B65D 23/003; B65D 23/12; B65D 2501/0081; B65D 2501/0027; E04B 1/2403; E04B 2001/2409; E04B 2001/2454; E04B 2/08; F16B 2200/10; F16B 2200/20; F16B 2200/30; F16B 2200/40; A45F 2200/0583
USPC ..... 108/180; 206/821, 503, 509, 427, 504; 215/10, 382, 383, 399; 220/23.4, 23.2, 220/480; 428/58, 99; 403/381, 331, 403/409.1, 333; 248/311.2; 224/414, 224/148.7; D9/743, 522, 569
See application file for complete search history.

(56) References Cited

U.S. PATENT DOCUMENTS

| | | | | | |
|---|---|---|---|---|---|
| 1,372,463 | A * | 3/1921 | Slobin | F16B 12/58 | 5/289 |
| 1,920,515 | A * | 8/1933 | Marsden | B65D 21/0202 | 215/10 |
| 3,225,951 | A * | 12/1965 | Poston | B60S 1/50 | 215/10 |
| 3,533,526 | A | 10/1970 | Adell | | |
| 3,685,866 | A * | 8/1972 | Patenaude | E04B 1/2403 | 403/189 |
| 4,262,467 | A * | 4/1981 | Faisant | A01G 9/027 | 52/311.2 |
| 4,366,922 | A | 1/1983 | Levine et al. | | |
| 4,624,383 | A * | 11/1986 | Moore | A63H 33/08 | 206/509 |

(Continued)

*Primary Examiner* — Gideon R Weinerth
(74) *Attorney, Agent, or Firm* — David Duckworth

(57) ABSTRACT

A beverage bottle is provided including a hollow body which has a top, a bottom and a substantially cylindrical sidewall. The beverage bottle's body has a tapered neck at the top of the bottle which terminates at the bottle's opening. In addition, the sidewall includes a pair of parallel longitudinally extending groves which form a projection between the grooves wherein the projection has a tapered edge at the bottle's tapered neck. In addition, the bottle's sidewall includes a longitudinally extending channel located diametrically opposed to the longitudinally extending projection. The channel extends from the bottle's bottom to the bottle's tapered neck and includes a diminishing depth at the bottle's tapered neck to form a tapered shelf. The projection and channel are configured so that the bottle's projection could be received within a channel of another similarly constructed beverage bottle so as to connect and affix two beverage bottles together.

9 Claims, 11 Drawing Sheets

(56) References Cited

U.S. PATENT DOCUMENTS 4,685,565 A * 8/1987 Sparling ..... B65D 21/02004 206/427
D300,303 S * 3/1989 Sparling ..... 206/427
4,817,809 A * 4/1989 Rozmestor ..... B25B 13/56 206/503
4,867,598 A * 9/1989 Winter, IV ..... E04B 2/08 403/381
5,105,958 A * 4/1992 Patton ..... A45F 3/16 215/14
5,244,300 A * 9/1993 Perreira ..... E04B 1/2403 403/381
5,251,777 A 10/1993 McMahon
D349,046 S * 7/1994 Brown ..... D21/500
D356,542 S * 3/1995 Finkiewicz ..... D12/411
5,433,416 A * 7/1995 Johnson ..... B65D 23/003 248/475.1
5,484,128 A * 1/1996 Franco, Sr. ..... B62J 11/00 224/274
D407,020 S * 3/1999 Doty ..... D9/520
6,276,549 B1 * 8/2001 Fasci ..... B65D 21/0202 220/23.4
6,415,624 B1 * 7/2002 Connors ..... B65D 21/0237 62/457.3
6,772,898 B1 8/2004 Florino et al.
6,808,090 B2 * 10/2004 Pedersen ..... B65D 25/22 215/399
7,225,937 B2 * 6/2007 Schroeder ..... B65B 61/202 206/497
D547,637 S * 7/2007 Blacker ..... D8/354
D586,225 S * 2/2009 Devereaux ..... D9/541
7,516,860 B1 4/2009 Fenton et al.
D673,855 S * 1/2013 Burgeson ..... D9/522
8,348,077 B2 * 1/2013 Wimmer ..... B65B 17/02 220/23.4
9,346,585 B2 * 5/2016 Hendrickson ..... B65D 21/0204
9,392,862 B1 7/2016 Hajianpour
D794,467 S * 8/2017 Hendrickson ..... D9/559
D806,553 S * 1/2018 Hendrickson ..... D9/559
9,856,053 B2 * 1/2018 Pisarevsky ..... A61J 7/04
9,922,582 B1 * 3/2018 Rock ..... G09F 3/10
10,138,917 B2 * 11/2018 Koch ..... F16B 5/0052
2004/0000550 A1 * 1/2004 Taccolini ..... A47J 47/16 220/23.4
2004/0134944 A1 * 7/2004 Dominguez ..... A45F 3/16 224/148.7
2005/0103959 A1 * 5/2005 Lee ..... B63C 11/18 248/223.41
2006/0261063 A1 * 11/2006 Dyehouse ..... B65D 21/0204 220/23.4
2007/0090077 A1 * 4/2007 Graber ..... B65D 21/0237 215/10
2009/0045157 A1 * 2/2009 Panchal ..... B65D 21/0204 215/10
2009/0090647 A1 * 4/2009 Panchal ..... B65D 21/0204 206/504
2009/0134111 A1 * 5/2009 Schroeder ..... B65D 5/4212 215/10
2009/0229292 A1 * 9/2009 Sweeney ..... A45F 5/02 62/259.3
2010/0254757 A1 * 10/2010 Saul ..... A47C 4/02 403/404
2010/0294816 A1 * 11/2010 Sentell ..... A45F 5/02 224/148.3
2010/0308043 A1 * 12/2010 Wimmer ..... B65B 17/02 220/23.4
2013/0213846 A1 * 8/2013 Hendrickson ..... B65D 21/0216 206/509
2013/0213927 A1 * 8/2013 Hendrickson ..... B65D 23/00 215/383
2014/0106108 A1 * 4/2014 Lin ..... A63H 33/082 428/58
2014/0202982 A1 * 7/2014 Willows ..... A45F 5/021 215/384
2016/0272368 A1 9/2016 Buck, III
2017/0079415 A1 3/2017 Willows et al.
2017/0081076 A1 * 3/2017 Meroz ..... B65D 21/0201

* cited by examiner

CONNECTABLE BEVERAGE BOTTLE

BACKGROUND OF THE INVENTION

The present invention relates to stackable bottles which permit bottles to be stacked on top of one another or affixed side-by-side.

Beverage containers are known for storing beverages. In addition, beverage containers have been designed to include projections and grooves for allowing the containers to be stacked and affixed together in various configurations to either save space or to form multi-pack clusters of bottles that are locked together during shipping. As but a few examples, U.S. Pat. No. D586,225 illustrates interlocking bottles having grooves and projections which allow multiple bottles to be affixed to each other. U.S. Pat. No. 4,685,565 describes interlocking beverage bottles including possesses vertically extending slots and vertically extending "tongue member" projections which are sized to fit within the slots. U.S. Pat. No. 5,105,958 describes a bottle having a projection which is sized to affix within the groove formed within a separate bracket assembly which, in turn, is affixed to a golf bag. U.S. Pat. No. 7,516,860 illustrates a bottle having a single projection and a single groove which allow for two bottles to be interlocked and affixed together. U.S. Pat. No. 6,722,898 illustrates describes interlocking bottles having a strange "S" shaped sidewall wherein two bottles can be affixed together. Interestingly, one bottle must be positioned upside-down.

Moreover, beverage containers have been designed to include projections and grooves for allowing the containers to be stacked in various fanciful manners so as to be played with by children. For example, U.S. Pat. No. 4,656,840 describes a stackable beverage container which has projections and grooves for allowing the containers to be affixed in various arrangements. Similarly, U.S. Pat. No. 7,175,498 describes a beverage container having round projections which fit into opposing slotted grooves. Moreover, the top threaded cap portion can affix into a groove in the bottom of the bottle. U.S. Pat. No. 8,201,699 illustrates a beverage bottle wherein the top threaded portion can be affixed into a bottom groove. In addition, the bottle has a flat side for fitting into a horizontal slot formed into the side of the bottle. The combination of the threaded top and round groove allows the bottles to be stacked, and the planar side and slot formed into the adjoining side allow the bottle to be arranged in various constructions.

Unfortunately, all of these beverage bottle suffer from various drawbacks. Some of these beverage bottle can be connected, but only in limited arrangements. Other beverage bottle designs are not aesthetically pleasing or are difficult to manufacture.

Therefore, it would be desirable to provide an improved connectable beverage bottle allowing any number of bottles to be affixed together.

It would be further desirable to provide a connectable beverage bottle which can be connected to other bottles to form a cluster of bottles which is ideal for sale to a consumer.

In addition, it would be desirable to provide a connectable beverage bottle which is ideal for being held by a consumer's hand.

Moreover, it would be desirable to provide a connectable beverage bottle which can be affixed to a mounting bracket which can, in turn, be affixed to other objects.

Further objects and advantages of the present invention will be apparent from the drawings and summary of the invention below.

SUMMARY OF THE INVENTION

In accordance with the invention, an improved connectable beverage bottle is provided for making a cluster of two or more bottles. In addition, the connectable beverage bottle is constructed to affix to other objects.

The bottle has a body including a top, a bottom, and a curved sidewall which collectively form a central cavity for storing liquids. The bottle's bottom is preferably planar and does not include an opening. Conversely, the bottle's top includes an opening for the introduction of a beverage during the manufacturing process and for the dispensement of the beverage by a consumer. Preferably, the opening is threaded and closeable by a threaded cap.

Preferably, the bottle's curved sidewall is substantially cylindrical and tapers inwardly at the bottle's top to form a tapered neck which terminates at the bottle's opening. As explained in greater detail below, the term "substantially cylindrical" is intended to be interpreted broadly to include bottle structures having grooves and indents, and include bottle shapes wherein the bottle has a single curved sidewall which form shapes which are circular or ellipsoid in cross-section. However, the term "substantially cylindrical bottle" is not intended to cover common six-sided bottles having a parallel top and bottom, parallel front and back sides, and parallel left and right sides. Furthermore, the terms "front", "back", "left side", "right side", "top", "bottom", "longitudinal", and "lateral" are being used for reference purposes, and a particular side of the bottle should not be considered to be so limited as being a front, back, left, right, top or bottom side.

In addition, that bottle's sidewall includes a pair of parallel grooves which extend longitudinally from said body's bottom to the bottle's tapered neck. The pair of grooves form a longitudinally extending projection between the grooves which extends from the bottle's bottom to the body's tapered neck wherein the projection diminishes radially inward to form a tapered edge. The sidewall further including a longitudinally extending channel located diametrically opposed to the sidewall's longitudinally extending projection. The channel extends from the bottle's bottom to the bottle's tapered neck where the channel's depth diminishes adjacent to the tapered neck to form a tapered shelf which is substantially parallel and diametrically opposed to the projection's tapered edge. The bottle's projection and channel are sized and configured so as to have substantially the same shape so that a projection of one bottle can be received within a channel of another like bottle so as to connect and affix two beverage bottles together.

In a preferred embodiment, the connectable beverage bottle is provided with a bracket for attaching the bottle to other objections. The bracket includes a vertically extending post having a shape and size similar to the top of the bottle's projection including having a tapered edge, so that it can be inserted and locked into a bottle's channel. The bracket further includes a fastener for affixing the bracket to another object. The fastener may be any construction known to the art for affixing one object to another such as screws, nuts and bolts, hook and pile, adhesive, etc. However, in a preferred embodiment, the fastener includes a pair of slots sized for allowing a person's belt to pass through the slots to affix the bracket to a person's waist, and in turn, affix a connectable beverage bottle to a person's waist. In another preferred embodiment, the fastener takes the form of a hook, such as an "L" shaped flange, for affixing upon other objects.

Therefore, it is a principal object of the present invention to provide an improved connectable beverage bottle permitting any number of bottles to be affixed together.

It is a further object of the present invention to provide a connectable beverage bottle which can be connected to other bottles to form a cluster of bottles which is ideal for sale to a consumer.

It is still a further object of the present invention to provide a connectable beverage bottle which is ideal for being held by a consumer's hand.

It is still a further object of the present invention to provide a connectable beverage bottle and mounting bracket combination which can be affixed to other objects.

DETAILED DESCRIPTION OF THE INVENTION

Figure 1:
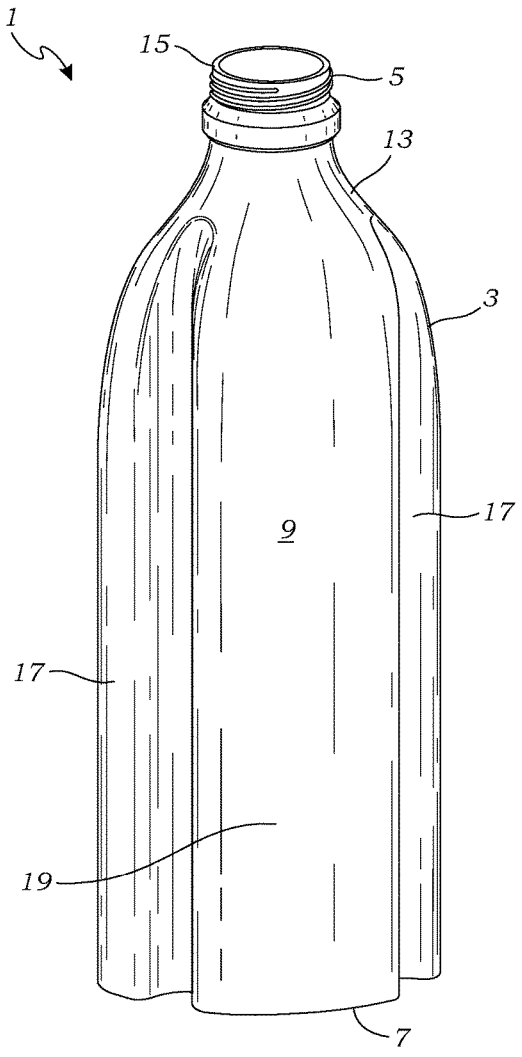
FIG. 1 is a top, left, front perspective view of the connectable beverage bottle of the present invention.
Figure 2:
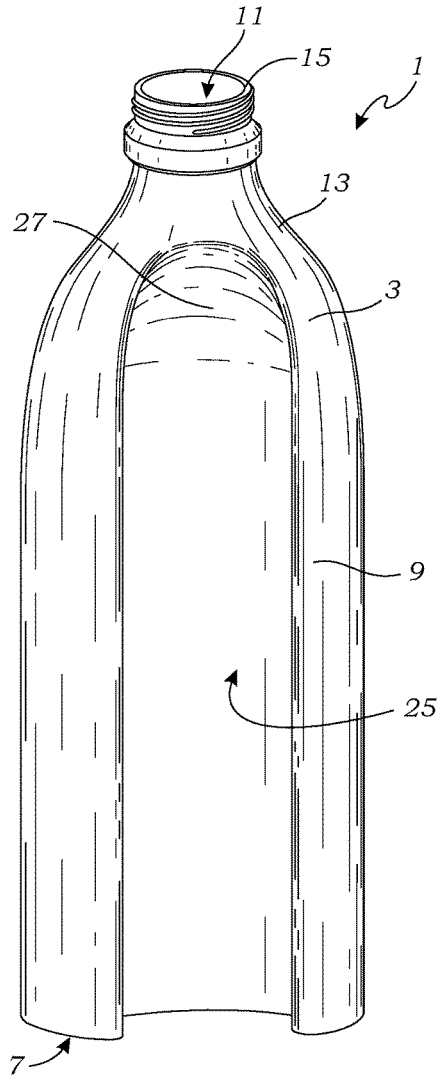
FIG. 2 is a top, rear, right perspective view of the connectable beverage bottle.
Figure 3:
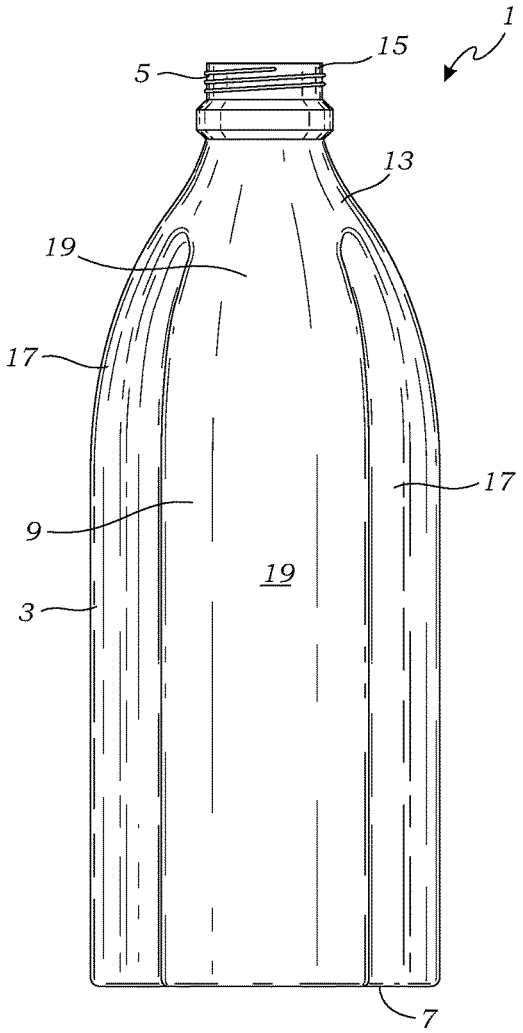
FIG. 3 is a front elevation view of the connectable beverage bottle.
Figure 4:
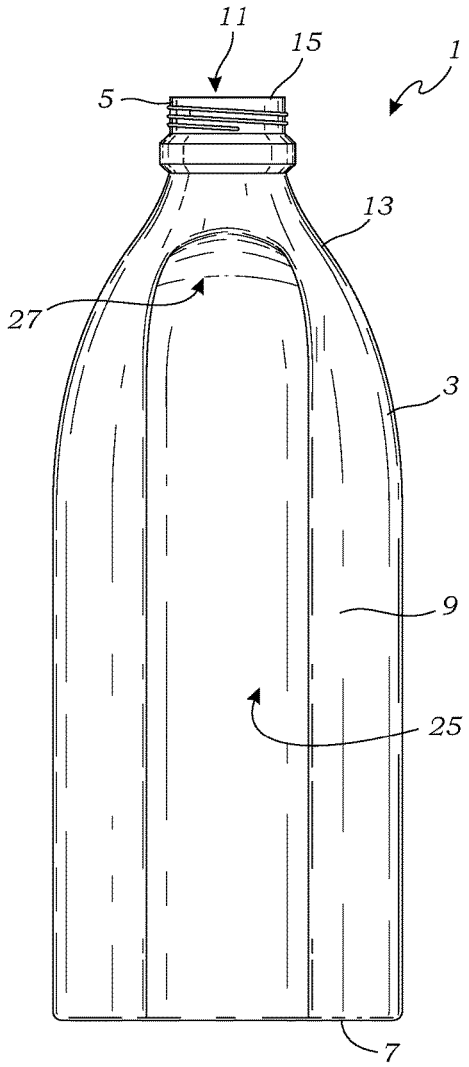
FIG. 4 is a rear elevation view of the connectable beverage bottle.

While the present invention is susceptible of embodiment in various forms, as shown in the drawings, hereinafter will be described the presently preferred embodiments of the invention with the understanding that the present disclosure is to be considered an exemplification of the invention, and the present disclosure is not intended to limit the invention to specific embodiments illustrated.

With reference to all of the Figures, the connectable beverage bottle 1 includes a body 3. The body 3 includes a top 5, a bottom 7, and a substantially cylindrical sidewall 9. The open top 5 includes an opening 15 which is preferably male threaded for accepting a female threaded cap (not shown). The bottle's body 3 (including its top 5, bottom 7 and sidewall 9) forms a central cavity 11 for storing a liquid.

The body's sidewall 9 is tapered towards the bottle's opening 15 to form a tapered neck region 13. In addition, the bottle's sidewall 9 includes a pair of groves 17 which are parallel and extend longitudinally from the bottle's bottom 7 to the bottle's tapered neck 13. The pair of grooves 17 form a projection 19 between the two recesses. The projection 19 extends parallel and longitudinally in relation to the beverage bottle's central axis. In addition, the projection 19 has a curved exterior surface coincident with the beverage bottle's side wall 9. Moreover, because the bottle has a diminishing diameter at the bottle's tapered neck 13, the projection 19 tapers toward the bottle's top 5 to form a tapered edge 21 within the bottle's tapered neck area 13.

The bottle's sidewall 9 further includes a channel 25 which extends from the bottle's bottom 7 to the beverage bottle's tapered neck 13. The channel 25 extends parallel and diametrically opposed to the bottle's longitudinally extending projection 19. Furthermore, the channel 25 has a size, shape and configuration substantially the same as the bottle's projection 19 including the channel having a depth that diminishes at the bottle's tapered neck so as to form a tapered shelf 27.

Figure 5:
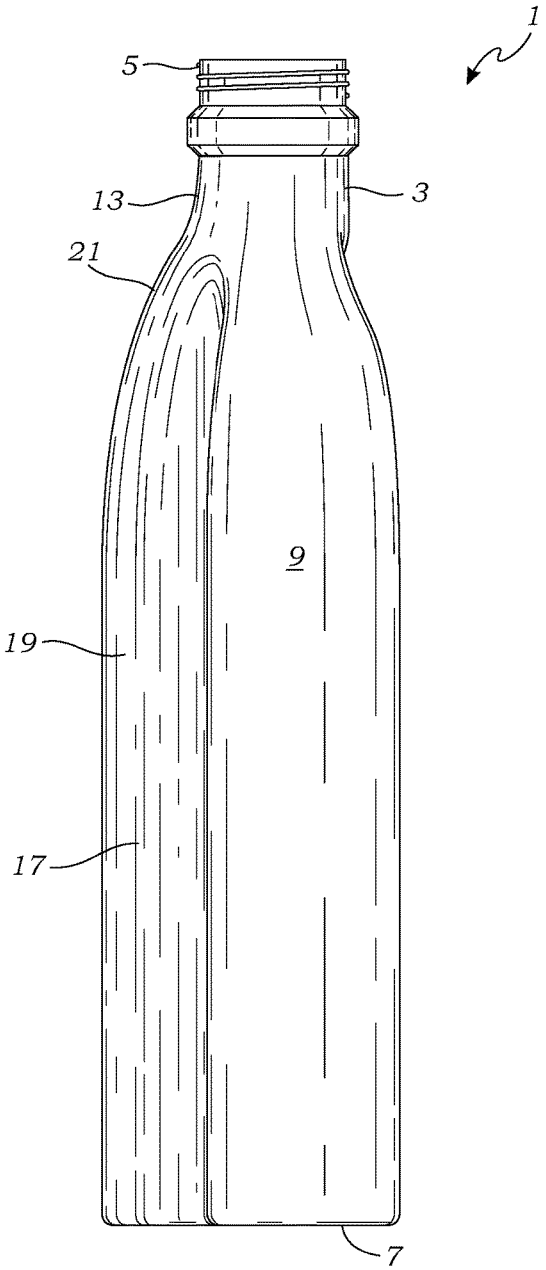
FIG. 5 is a right elevation view of the connectable beverage bottle.
Figure 6:
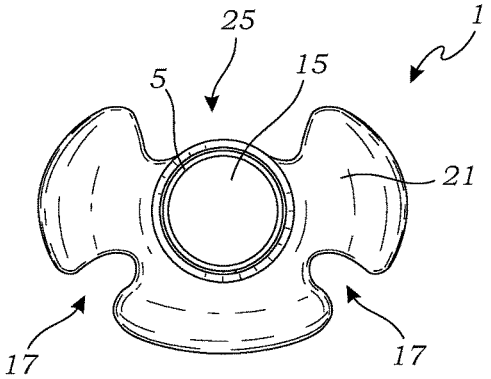
FIG. 6 is a top plan view of the connectable beverage bottle.
Figure 7:
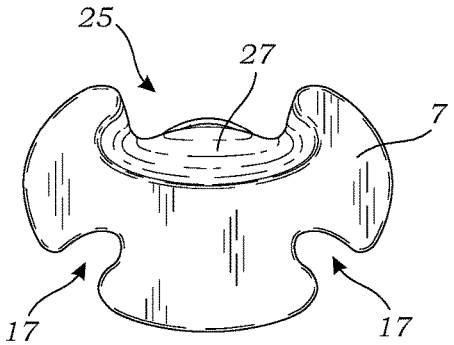
FIG. 7 is a bottom plan view of the connectable beverage bottle.
Figure 8:
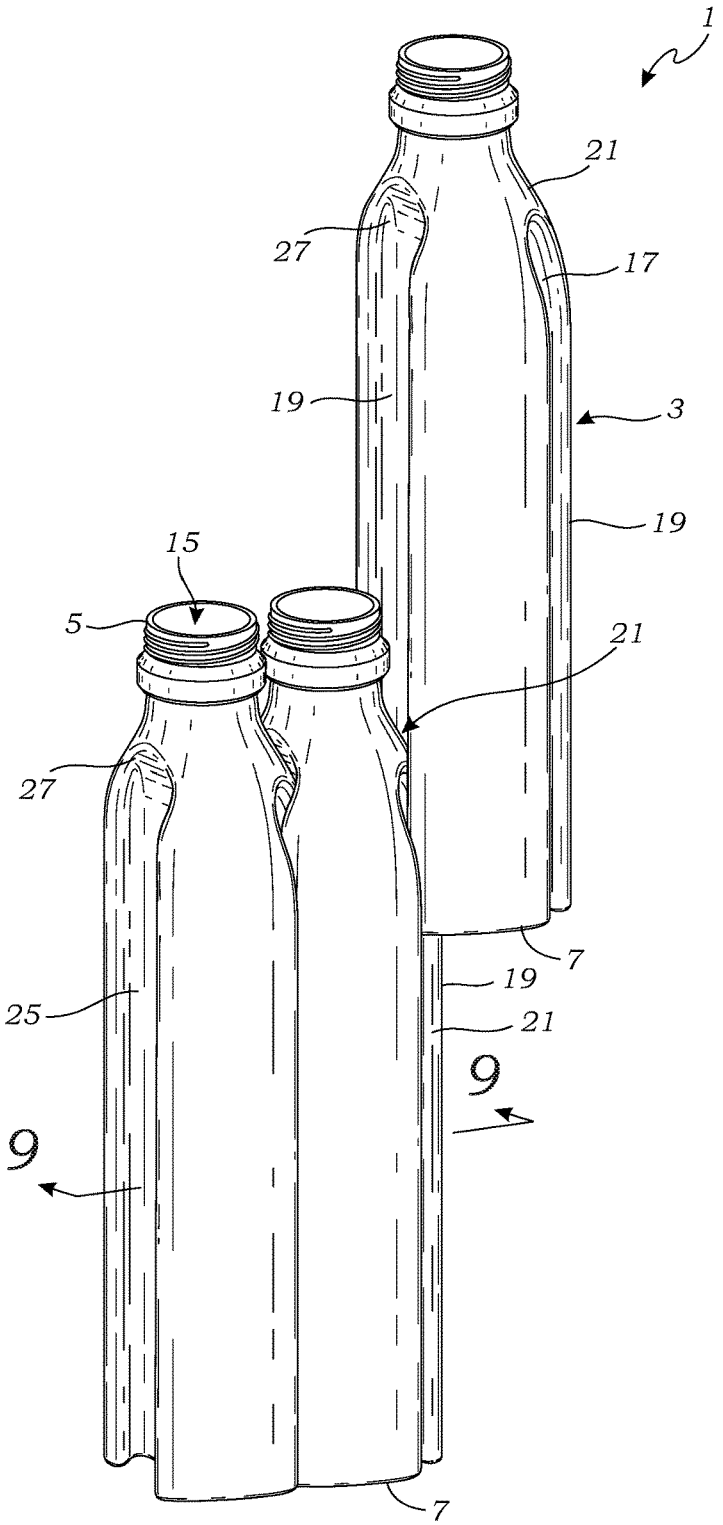
FIG. 8 is an environmental top, rear, left perspective view illustrating three connectable beverage bottles connected together.
Figure 9:
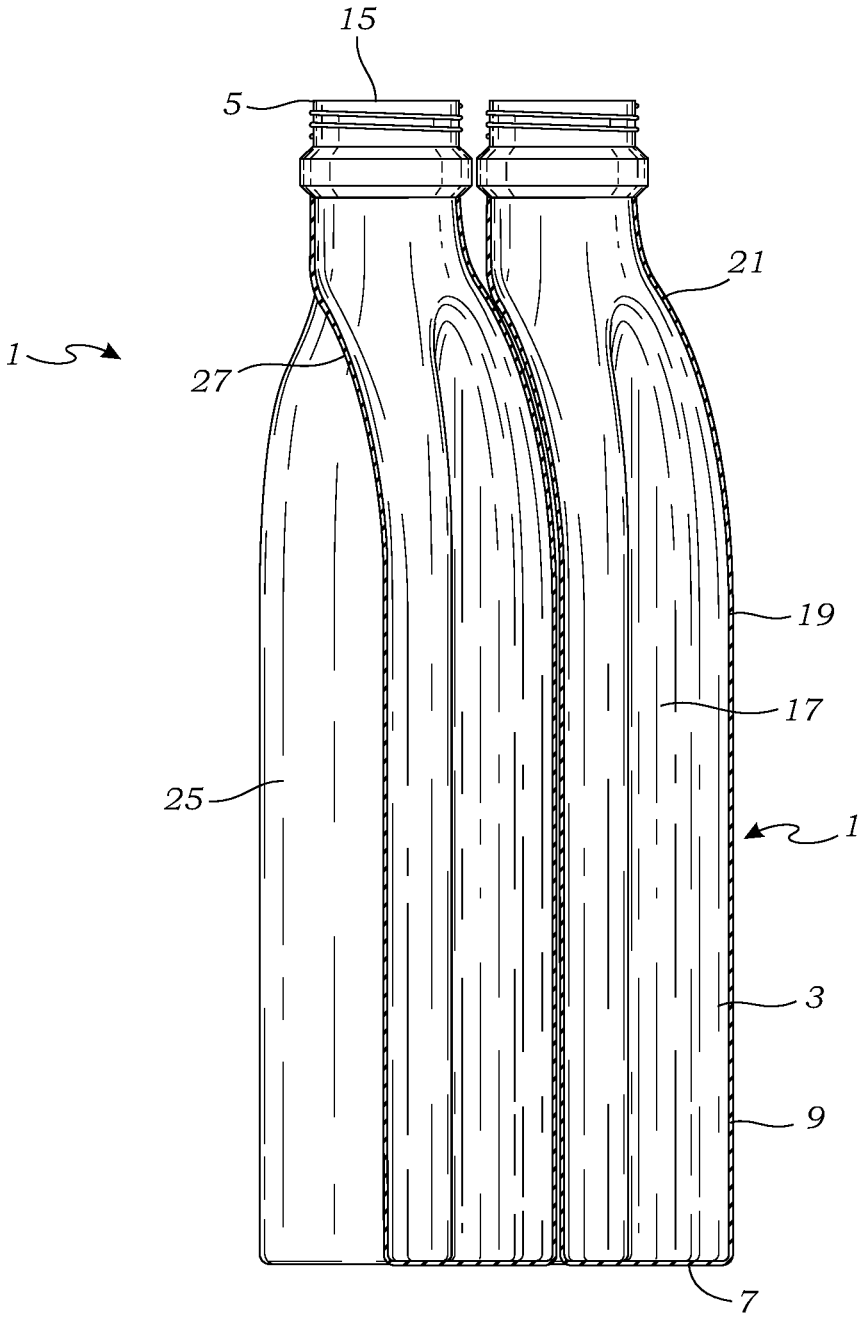
FIG. 9 is an environmental right side elevation cut-away of two connectable beverage bottles shown in FIG. 8.
Figure 10:
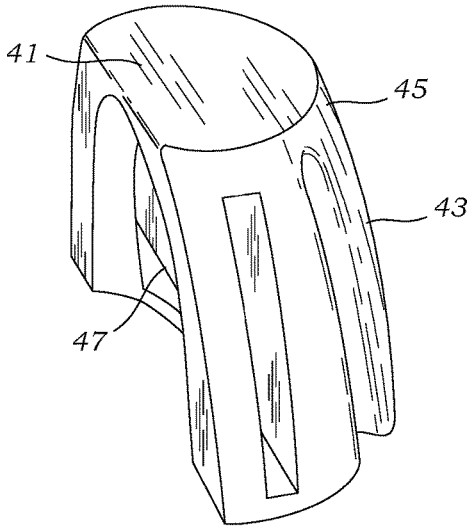
FIG. 10 is a top, rear left perspective view of a belt buckle mounting bracket for use with the connectable beverage bottles shown in FIGS. 1-9.
Figure 11:
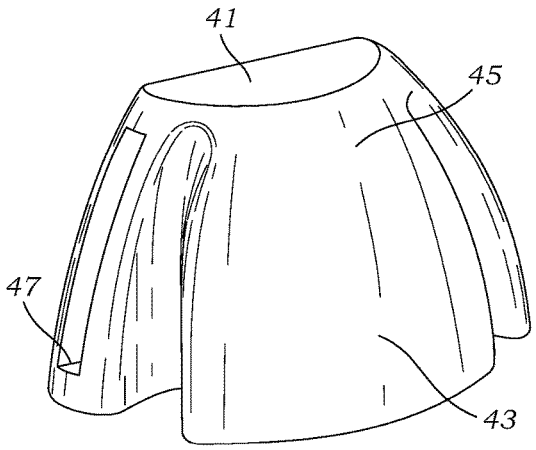
FIG. 11 is a top, front left perspective view of the belt buckle mounting bracket shown in FIG. 10.
Figure 12:
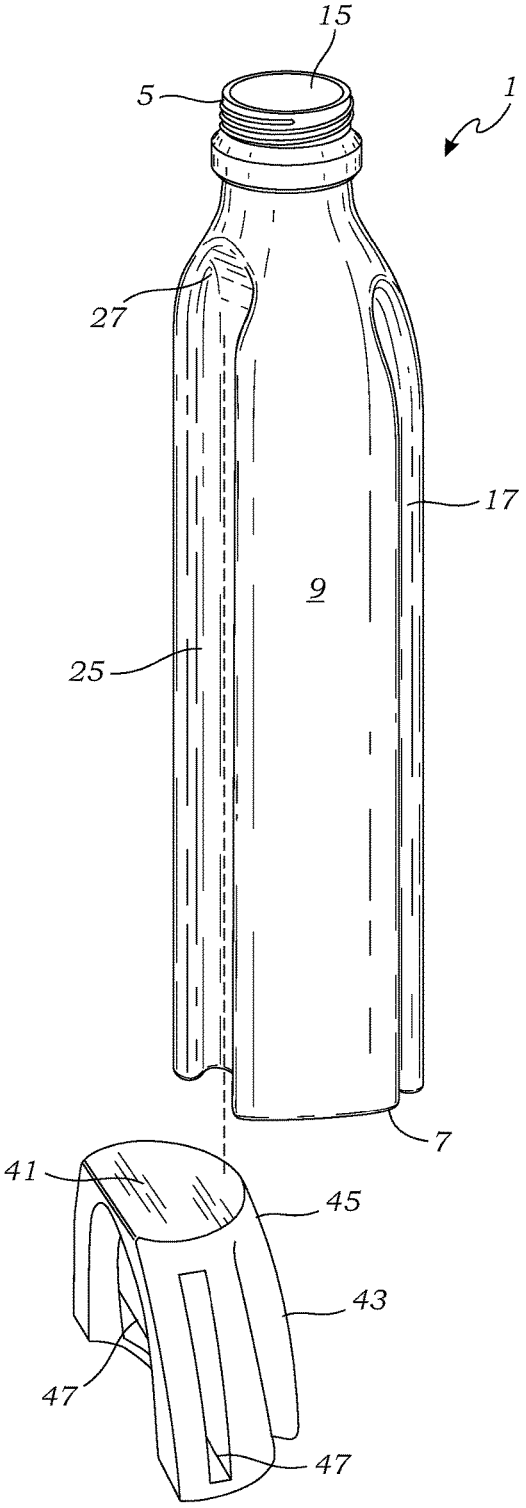
FIG. 12 is an environmental top, rear, left side perspective view of the connectable beverage bottle shown in FIGS. 1-9 above a belt buckle mounting bracket shown in FIGS. 10 and 11.
Figure 13:
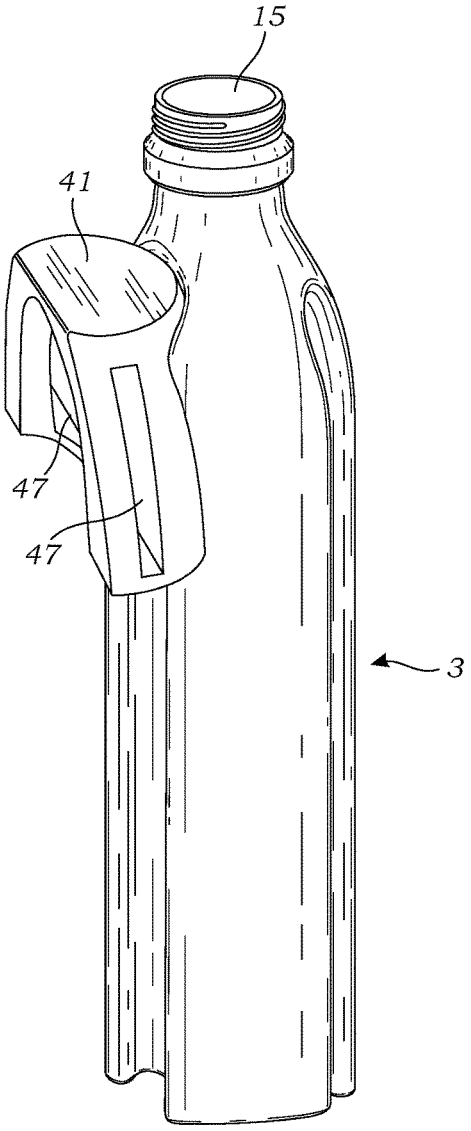
FIG. 13 is an environmental top, rear, left side perspective view of the connectable beverage bottle shown in FIGS. 1-9 affixed to a belt buckle mounting bracket shown in FIGS. 10 and 11.
Figure 14:
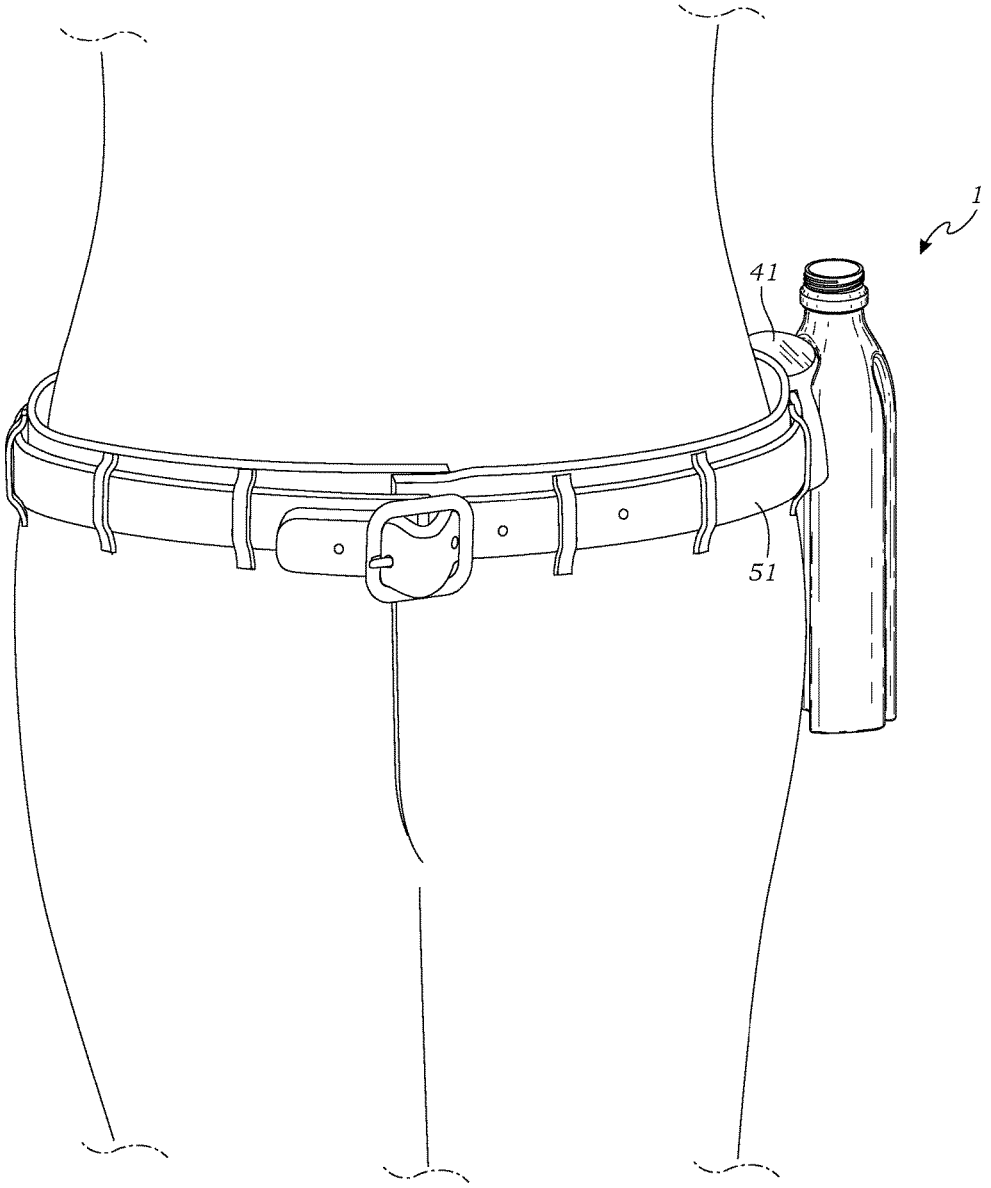
FIG. 14 is an environmental top, rear, right perspective view of the connectable beverage bottle affixed to a human being using a belt buckle mounting bracket shown in FIGS. 10 and 11.
Figure 15:
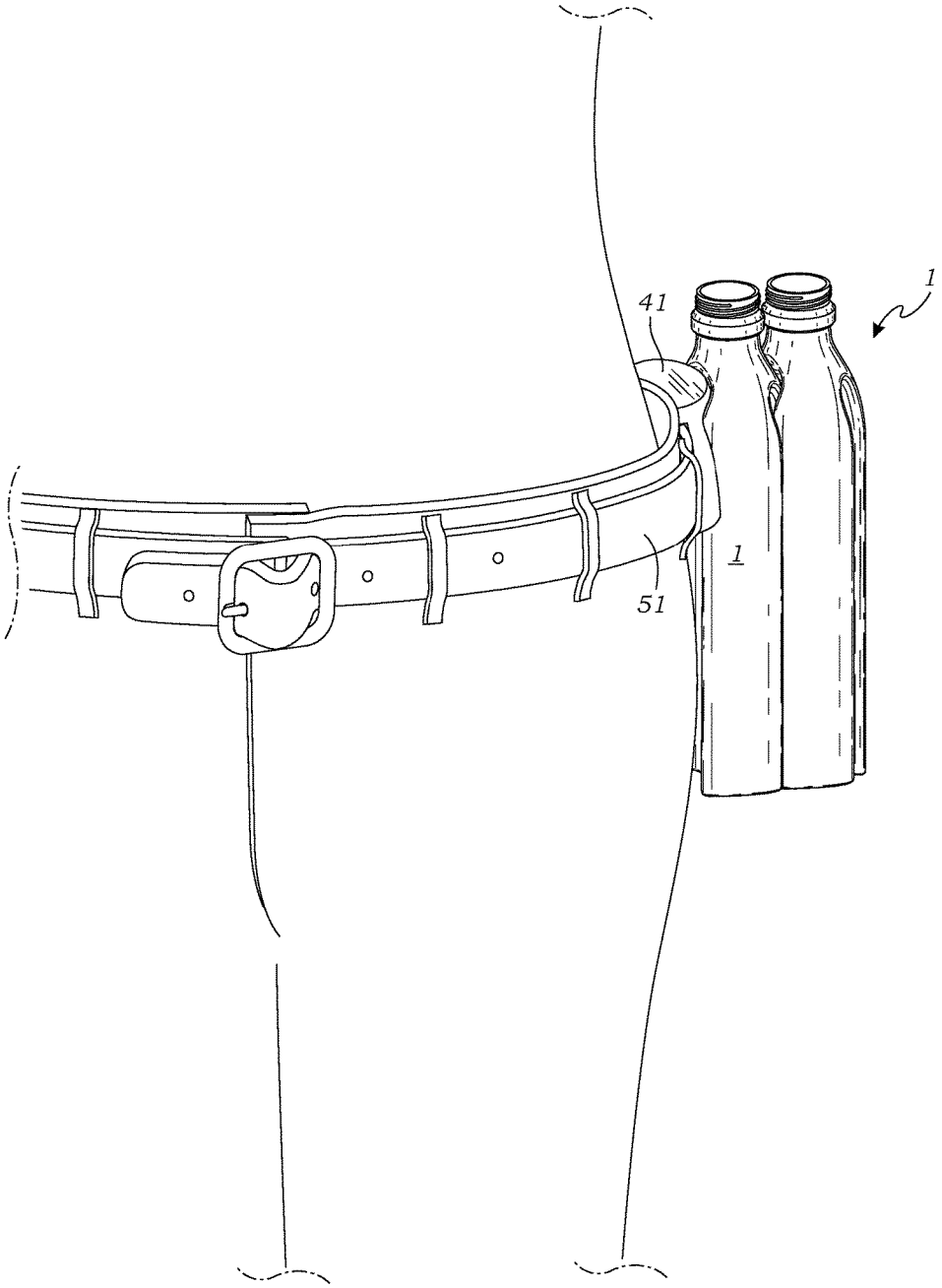
FIG. 15 is an environmental top, rear, right perspective view of two connected beverage bottles affixed to a human being using a belt buckle mounting bracket shown in FIGS. 10 and 11.
Figure 16:
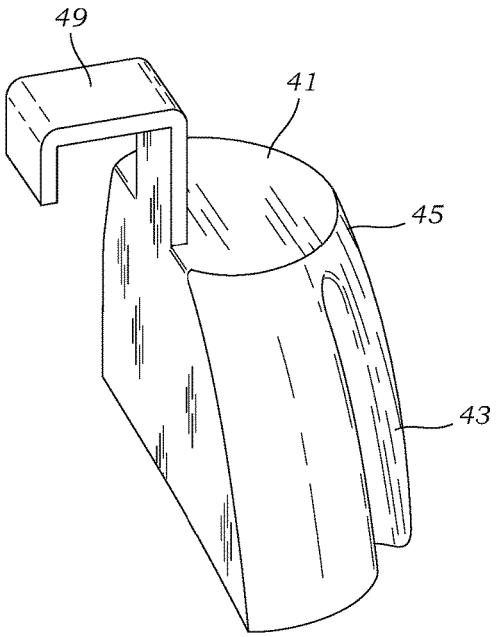
FIG. 16 is a top, rear left perspective view of a "hook" mounting bracket for use with the connectable beverage bottles shown in FIGS. 1-9.
Figure 17:
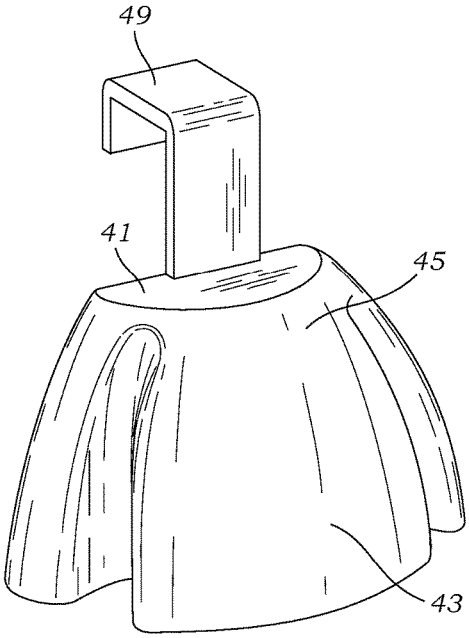
FIG. 17 is a top, front left perspective view of the "hook" mounting bracket shown in FIG. 16.
Figure 18:
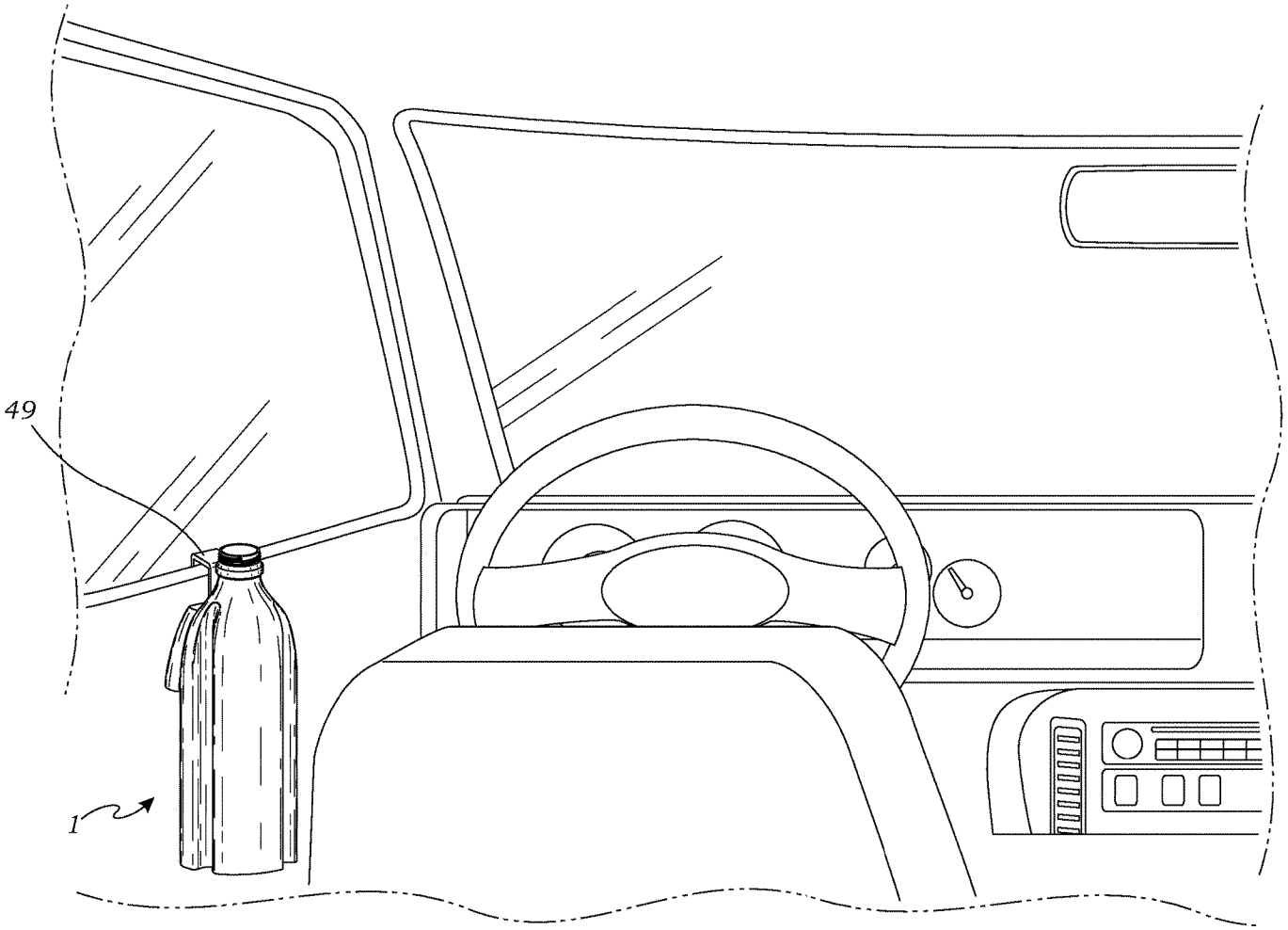
FIG. 18 is an environmental top, rear, right perspective view of the connectable beverage bottle affixed to a vehicle window sill using the "hook" mounting bracket shown in FIGS. 16 and 17.

As a result of the bottle's projection 19 and channel 25 having substantially the same shape, a projection 19 of one bottle can be received within the channel of another like bottle so as to affix two beverage bottles together as illustrated in FIGS. 8, 9 and 15. Furthermore, as best illustrated in FIG. 5, because the projections tapered edge 21 and the channel's depth 25 diminish in a parallel manner towards the top 5 of the bottle. The projection 19 can only be inserted into the bottle's channel 25 at the bottom 7 of another beverage bottle 1. This construction allows for one bottle to rest upon another bottle, as illustrated in FIG. 15.

In a preferred embodiment illustrated in FIGS. 10-18, the connectable beverage bottle 1 is provided with a bracket 41. The bracket 41 includes a post 43 having an upper tapered edge 45 so that the post has a size and shape substantially identical to the tapered edge region of a beverage bottle's projection 21. Because the post 43 has a size and shape similar to the top of a bottle's projection, it can be inserted into the bottom of a bottle's channel 25, and thereafter slid within the channel until engaging the channel's tapered shelf 27.

In addition, the bracket 41 includes a fastener for affixing the bracket 41 to another object. The bracket fastener may be of any construction known to those skilled in the art. However, in a first preferred embodiment illustrated in FIGS. 10-15, the fastener includes a pair of slots 47 sized for receiving a belt 51 illustrated in FIG. 14. In a second preferred embodiment of the bracket illustrated in FIGS. 16-18, the bracket 41 includes a hook 49. The hook 49 can have various shapes and sizes, however, in preferred embodiment illustrated in FIGS. 16-18, the hook is substantially "L" shaped and sized to fit within the window jam of an automobile. (See FIG. 18).

The connectable beverage bottle 1 can be used to store any liquid or granular solid. However, the beverage bottle is believed to have particular application for storing, transporting, and dispensing drinkable beverages such as water, soft drinks, energy drinks, juices, milk, etc. Moreover, the connectable beverage bottle can be any size, including but not limited to from one ounce to many gallons, including but not limited to six ounce, 12 ounce, 16 ounce, pint, liter, half gallon, and gallon sizes.

While several particular forms of the invention have been illustrated and described, it will be apparent the various modifications can be made without departing from the spirit and scope of the invention. Since the present invention encompasses numerous embodiments not described or illustrated, the present disclosure is not intended to limit the invention except for the following claims. Having described my invention in such terms so as to enable a person skilled in the art to understand the invention, we create the invention and practice it, and having presently identified the presently preferred embodiments thereof,

I claim:

1. A connectable beverage bottle comprising:

a hollow body including a top, a bottom and a substantially cylindrical sidewall which form a central cavity, said sidewall tapering inward adjacent to said hollow body's top to form a tapered neck which terminates at an opening for the ingress and egress of liquids or solids into said central cavity;

said sidewall including a pair of parallel grooves inset within the circumference of the substantially cylindrical sidewall which extend longitudinally from said hollow body's bottom to said tapered neck, said pair of grooves forming a longitudinally extending projection between said grooves which extends from said hollow body's bottom to said hollow body's tapered neck wherein said projection radially tapers to form a tapered rounded edge;

said sidewall further including a longitudinally extending channel located diametrically opposed to said longitudinally extending projection, said channel extending from the hollow body's bottom to said hollow body's tapered neck with said channel's depth diminishing in a tapered manner adjacent to said tapered neck to form a tapered rounded shelf which is substantially parallel and diametrically opposed to said projection's tapered rounded edge; and said projection and said channel are sized and configured so that said projection could be received within a channel of another like connectable beverage bottle so as to connect and affix to another like connectable beverage bottle.

2. The connectable beverage bottle of claim 1 wherein:

said projection's tapered edge and said channel's tapered shelf permit said projection to be inserted into a channel of a like connectable bottle at the hollow body's bottom, but not at the hollow body's top; and said projection and said channel are sized and configured so that once said projection is inserted into a channel of a like connectable bottle, said projection is slideable within the channel until said projection's tapered edge would engage the channel's tapered shelf so as to prevent further movement or disengagement.

3. The connectable beverage bottle of claim 1 further comprising:

a bracket including a longitudinally extending post having a tapered top, said post sized and configured to have the same shape as said channel so as to be received within channel, and said bracket including a fastener means for affixing said bracket to another object.

4. The connectable beverage bottle of claim 3 wherein said fastener means includes a pair of slots sized to receive a belt.

5. The connectable beverage bottle of claim 3 wherein said fastener means includes a hook.

6. A combination of connectable beverage bottles comprising:

a first connectable beverage bottle including, a hollow body including a top, a bottom and a substantially cylindrical sidewall which form a central cavity, said sidewall tapering inward adjacent to said hollow body's top to form a tapered neck which terminates at an opening for the ingress and egress of liquids or solids into said central cavity;

said sidewall including a pair of parallel grooves inset within the circumference of the substantially cylindrical sidewall which extend longitudinally from said hollow body's bottom to said tapered neck, said pair of grooves forming a longitudinally extending projection between said grooves which extends from said hollow body's bottom to said hollow body's tapered neck wherein said projection radially tapers to form a tapered rounded edge;

said sidewall further including a longitudinally extending channel located diametrically opposed to said longitudinally extending projection, said channel extending from the hollow body's bottom to said hollow body's tapered neck with said channel's depth diminishing in a tapered manner adjacent to said tapered neck to form a tapered rounded shelf which is substantially parallel and diametrically opposed to said projection's tapered rounded edge; and a second connectable beverage bottle including, a hollow body including a top, a bottom and a substantially cylindrical sidewall which form a central cavity, said sidewall tapering inward adjacent to said hollow body's top to form a tapered neck which terminates at an opening for the ingress and egress of liquids or solids into said central cavity;

said sidewall including a pair of parallel grooves inset within the circumference of the substantially cylindrical sidewall which extend longitudinally from said hollow body's bottom to said tapered neck, said pair of grooves forming a longitudinally extending projection between said grooves which extends from said hollow body's bottom to said hollow body's tapered neck wherein said projection radially tapers to form a tapered rounded edge;

said sidewall further including a longitudinally extending channel located diametrically opposed to said longitudinally extending projection, said channel extending from the hollow body's bottom to said hollow body's tapered neck with said channel's depth diminishing in a tapered manner adjacent to said tapered neck to form a tapered rounded shelf which is substantially parallel and diametrically opposed to said projection's tapered rounded edge; and said first bottle's projection sized and configured to have the same shape as said channel so as to be received within said second bottle's channel so as to connect and affix to said first bottle to said second bottle.

7. The connectable beverage bottle of claim 6 further comprising:

a bracket including a longitudinally extending post having a tapered top, said post sized and configured to have the same shape as said channel so as to be received within channel, and said bracket including a fastener means for affixing said bracket to another object.

8. The connectable beverage bottle of claim 7 wherein said fastener means includes a pair of slots sized to receive a belt.

9. The connectable beverage bottle of claim 7 wherein said fastener means includes a hook.

* * * * *